US008818234B2

(12) United States Patent
Takemoto et al.

(10) Patent No.: US 8,818,234 B2
(45) Date of Patent: Aug. 26, 2014

(54) IMAGE FORMING APPARATUS

(75) Inventors: Hideyuki Takemoto, Kanagawa (JP); Makoto Yoshioka, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 160 days.

(21) Appl. No.: 13/328,631

(22) Filed: Dec. 16, 2011

(65) Prior Publication Data

US 2012/0219319 A1 Aug. 30, 2012

(30) Foreign Application Priority Data

Feb. 24, 2011 (JP) ..... 2011-038969
Sep. 27, 2011 (JP) ..... 2011-210249

(51) Int. Cl.
*G03G 21/18* (2006.01)

(52) U.S. Cl.
USPC ..... 399/113

(58) Field of Classification Search
USPC ..... 399/107, 111, 113
See application file for complete search history.

(56) References Cited

U.S. PATENT DOCUMENTS

| | | | |
|---|---|---|---|
| 7,869,738 | B2 | 1/2011 | Takemoto |
| 2007/0264032 | A1 | 11/2007 | Harumoto |
| 2009/0123175 | A1 | 5/2009 | Takemoto |
| 2009/0218472 | A1 | 9/2009 | Takemoto |
| 2009/0274484 | A1 | 11/2009 | Takemoto |
| 2009/0304412 | A1 | 12/2009 | Hattori et al. |
| 2010/0098457 | A1 | 4/2010 | Watanabe |
| 2010/0202797 | A1 | 8/2010 | Kikuchi et al. |
| 2010/0290813 | A1 * | 11/2010 | Okabe et al. ..... 399/228 |

FOREIGN PATENT DOCUMENTS

| | | | |
|---|---|---|---|
| CN | 101071282 | A | 11/2007 |
| CN | 101470396 | A | 7/2009 |
| JP | 04-291362 | | 10/1992 |
| JP | 2007-47720 | A | 2/2007 |
| JP | 2007-178657 | A | 7/2007 |
| JP | 2008-139818 | A | 6/2008 |
| JP | 2008-262096 | A | 10/2008 |
| JP | 2010-002627 | A | 1/2010 |
| JP | 2010-009011 | A | 1/2010 |

OTHER PUBLICATIONS

European Office Action dated Oct. 23, 2013, for corresponding European Patent Application No. 12154743.4.
Extended European Search Report dated Oct. 23, 2013.
Chinese Office Action dated Mar. 17, 2014 for corresponding Chinese Application No. 20120040742.8.

* cited by examiner

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

An image forming apparatus including a process cartridge detachably installable in a main body of the image forming apparatus, a main reference portion receiver to receive a main reference portion provided to the process cartridge, a sub-reference portion receiver to receive a sub-reference portion provided to the process cartridge, and a pressing mechanism to press the process cartridge to cause the main reference portion to contact the main reference portion receiver upon installation of the process cartridge in the main body of the image forming apparatus. The pressing mechanism presses the process cartridge in a direction angled with respect to a line connecting a center of the main reference portion with a contact position where the pressing mechanism contacts the process cartridge.

13 Claims, 7 Drawing Sheets

IMAGE FORMING APPARATUS

CROSS-REFERENCE TO RELATED APPLICATIONS

The present patent application is based on and claims priority pursuant to 35 U.S.C. §119 from Japanese Patent Application Nos. 2011-038969, filed on Feb. 24, 2011, and 2011-210249, filed on Sep. 27, 2011, both in the Japan Patent Office, each of which is incorporated by reference herein in its entirety.

BACKGROUND OF THE INVENTION

1. Field of the Invention

Exemplary aspects of the present invention generally relate to an image forming apparatus such as a printer, a facsimile machine, and a copier.

2. Description of the Background Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

Image forming apparatuses often use a process cartridge detachably installable in the image forming apparatuses. The process cartridge includes the photoconductor and at least one of the charger, the developing device, the cleaning device, and other process units provided around the photoconductor within a casing thereof. A main reference portion and a sub-reference portion are generally provided to the process cartridge for positioning the process cartridge relative to the body of the image forming apparatus. When the process cartridge is inserted into the image forming apparatus in an X-axis direction, the main reference portion positions the process cartridge relative to the body of the image forming apparatus in Y-axis and Z-axis directions, both of which are perpendicular to the X-axis direction. The sub-reference portion positions the process cartridge relative to the body of the image forming apparatus around the X axis. An insertion hole serving as a main reference portion receiver into which the main reference portion is inserted and a slot serving as a sub-reference portion receiver into which the sub-reference portion is inserted are formed in the body of the image forming apparatus. The slot extends parallel to a line connecting the center of the main reference portion with the center of the sub-reference portion along the X axis. The main reference portion is inserted into the insertion hole to position the process cartridge relative to the body of the image forming apparatus in both the Y-axis and Z-axis directions. The sub-reference portion is inserted into the slot to position the process cartridge relative to the body of the image forming apparatus around the X axis.

In a case in which the main reference portion is inserted loosely into the insertion hole due to manufacturing tolerance or the like, a load exerted during operation moves the main reference portion within the insertion hole, possibly resulting irregular images including banding and so forth. In addition, in a full-color image forming apparatus in which multiple process cartridges for each color are installed therein, loose installation of the process cartridges may cause color shift in output images.

To counteract the effect of the operating load, the image forming apparatus can be given a pressing unit that presses the main reference portion inserted into the insertion hole against one side of the insertion hole to keep it stationary. Accordingly, the main reference portion is prevented from moving within the insertion hole even when it is inserted into the insertion hole with looseness. As a result, the process cartridge is accurately positioned relative to the body of the image forming apparatus in both the Y-axis and Z-axis directions.

However, in such an arrangement the process cartridge shakes against the body of the image forming apparatus around the X axis when the sub-reference portion is short relative to the width of the slot due to manufacturing tolerance. Consequently, the operating load moves the process cartridge around the X axis, possibly resulting in irregular images including banding and so forth. It is conceivable that a second pressing unit that presses the sub-reference portion toward a lateral direction of the slot is further provided to the image forming apparatus to prevent movement of the process cartridge around the X axis. However, provision of the second pressing unit increases number of components and production costs.

SUMMARY

In view of the foregoing, illustrative embodiments of the present invention provide a novel image forming apparatus in which both a main reference portion and a sub-reference portion of a process cartridge are accurately positioned relative to the body of the image forming apparatus without looseness using a reduced number of components.

In one illustrative embodiment, an image forming apparatus includes a process cartridge detachably installable in a main body of the image forming apparatus and having an image carrier and at least one processing unit provided adjacent to the image carrier, a main reference portion receiver to receive a main reference portion provided to the process cartridge, a sub-reference portion receiver to receive a sub-reference portion provided to the process cartridge, and a pressing mechanism to press the process cartridge to cause the main reference portion to contact the main reference portion receiver upon installation of the process cartridge in the main body of the image forming apparatus. The pressing mechanism presses the process cartridge in a direction angled with respect to a line connecting a center of the main reference portion with a contact position where the pressing mechanism contacts the process cartridge.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
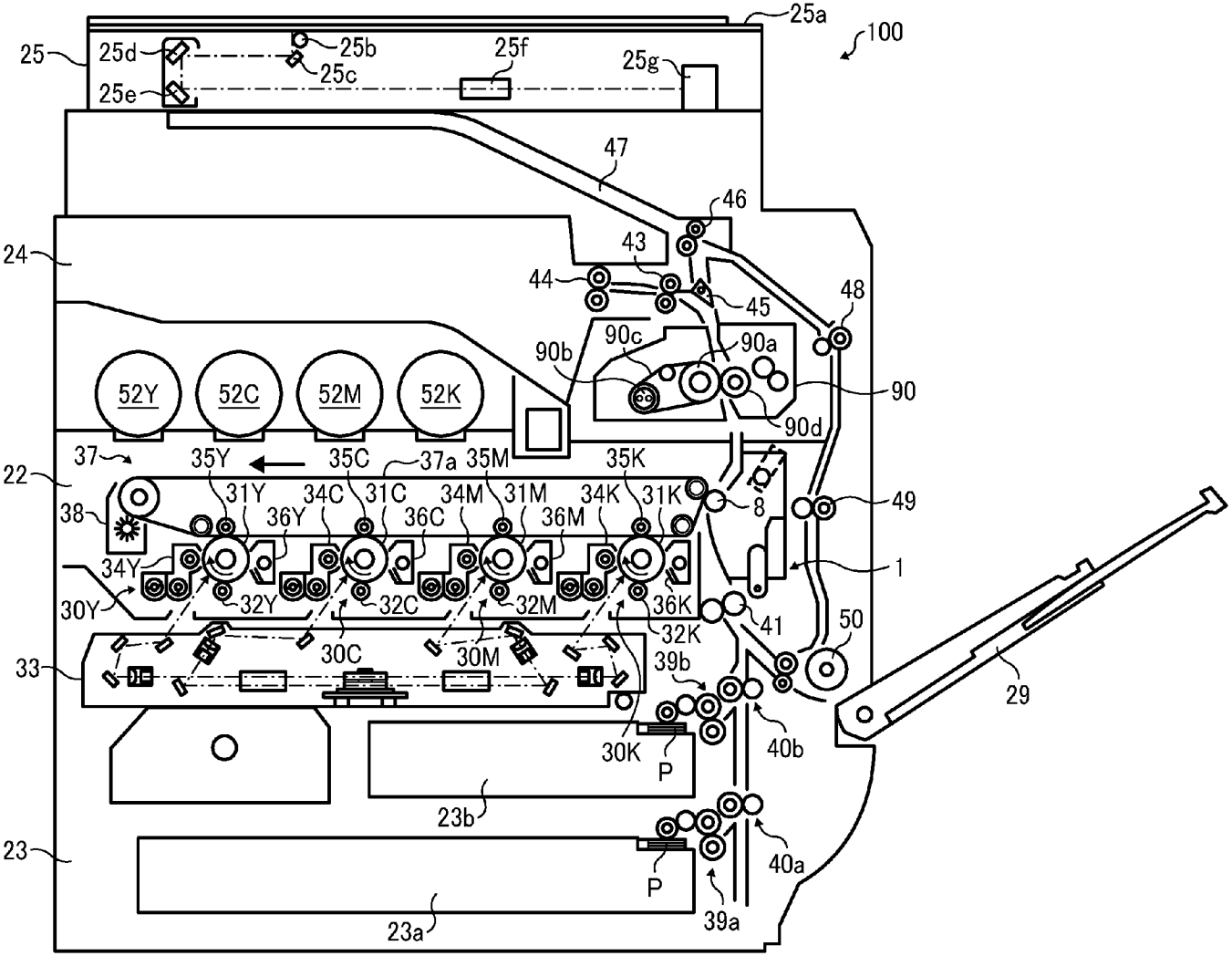
FIG. 1 is a vertical cross-sectional view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration of a copier employing an electrophotographic system serving as an image forming apparatus 100 according to illustrative embodiments.

FIG. 1 is a vertical cross-sectional view illustrating an example of a configuration of the image forming apparatus 100. The image forming apparatus 100 includes a printer unit 22 serving as a tandem-type image forming unit provided substantially at the center of the body of the image forming apparatus 100 and a sheet feeder 23 provided below the printer unit 22. The image forming apparatus 100 further includes an internal sheet discharger 24 provided above the printer unit 22 and a scanner 25 serving as a document reader provided above the sheet discharger 24.

The scanner 25 includes a contact glass 25*a* serving as a document stand on which a document is placed, a light source 25*b* that directs light onto the document, first, second, and third mirrors 25*c*, 25*d*, and 25*e*, each of which reflects light reflected from the document, an imaging lens 25*f* on which the light reflected from the document is focused, an image sensor 25*g* serving as a reading unit such as a CCD that is provided at an image forming position to read an image of the document, and so forth. Although not shown, a pressing plate that presses the document placed on the contact glass 25*a*, an automatic document feeder (ADF) that automatically feeds the document onto the contact glass 25*a*, and so forth are provided above the scanner 25.

The printer unit 22 includes four process cartridges 30Y, 30C, 30M, and 30K (hereinafter collectively referred to as process cartridges 30) to form an image of a specific color, that is, yellow (Y), cyan (C), magenta (M), or black (K). An intermediate transfer unit 37 including a seamless intermediate transfer belt 37*a* is provided above the process cartridges 30, and an optical writing unit 33 is provided below the process cartridges 30.

The process cartridges 30 have the same basic configuration, only differing in the color of toner used, and include photoconductors 31Y, 31C, 31M, and 31K (hereinafter collectively referred to as photoconductors 31) each serving as an image carrier. Chargers 32Y, 32C, 32M, and 32K (hereinafter correctively referred to as chargers 32), developing devices 34Y, 34C, 34M, and 34K (hereinafter collectively referred to as developing devices 34), primary transfer rollers 35Y, 35C, 35M, and 35K (hereinafter collectively referred to as primary transfer rollers 35), and cleaning devices 36Y, 36C, 36M, and 36K (hereinafter collectively referred to as cleaning devices 36) are provided around the photoconductors 31, respectively. The process cartridges 30 respectively include process units such as the photoconductors 31, the chargers 32, the developing devices 34, and the cleaning devices 36, and are detachably installable in the body of the image forming apparatus 100.

The optical writing unit 33 is provided opposite the four process cartridges 30 and includes a single deflector at the center thereof. Light beams emitted from four light sources are sorted into four paths by the deflector to scan the photoconductors 31 with the respective deflected light beams. Accordingly, latent images are written on the photoconductors 31, respectively. Specifically, the optical writing unit 33 includes the four light sources such as laser diodes for the specified colors, an optical system to collimate laser beams emitted from the light sources, the single deflector such as a polygon scanner constructed of a polygon mirror and a polygon motor, lenses used for scanning and image formation such as fθ lenses disposed along optical paths of each of the light sources, correction lenses, mirrors, and so forth. The laser beams emitted from the laser diodes based on image data of the specified colors are deflected by the polygon scanner and are directed onto the respective photoconductors 31.

Toner bottles 52Y, 52C, 52M, and 52K (hereinafter collectively referred to as toner bottles 52) that supply toner to the respective developing devices 34 are provided between the printer unit 22 and the sheet discharger 24. Toner of yellow (Y), cyan (C), magenta (M), and black (K) are stored in the toner bottles 52, respectively. A predetermined amount of toner is supplied to the corresponding developing devices 34 from the toner bottles 52 via supply paths, not shown, respectively.

The intermediate transfer belt 37*a* included in the intermediate transfer unit 37 is supported by a drive roller, a driven roller, and the primary transfer rollers 35, and is rotated in a counterclockwise direction in FIG. 1. A secondary transfer unit 1 including a secondary transfer roller 8 is provided on the right of the intermediate transfer belt 37*a* in FIG. 1. In addition, a belt cleaning device 38 is provided on the left of the intermediate transfer belt 37*a*.

A first sheet feed cassette 23*a* and a second sheet feed cassette 23*b* each storing recording media such as sheets P are provided one above the other in the sheet feeder 23. The sheet P is fed from one of the first and second sheet feed cassettes 23*a* and 23*b* by a first sheet feeder 39*a* or a second sheet feeder 39*b* to be conveyed to a registration roller 41 via a first conveyance roller 40*a* or a second conveyance roller 40*b*. The sheet P is then conveyed to the secondary transfer roller 8 at a predetermined timing by the registration roller 41.

The image forming apparatus 100 further includes a fixing device 90 provided above the secondary transfer unit 1. The fixing device 90 includes a fixing roller 90*a*, a heat roller 90*b*, a fixing belt 90*c* supported by the fixing roller 90*a* and the head roller 90*b*, and a pressing roller 90*d* pressed against the fixing belt 90*c*. A conveyance roller 43 and a discharge roller 44 to convey and discharge the sheet P to the sheet discharger 24 are provided above the fixing device 90. A switching pick 45 that switches conveyance paths of the sheet P during duplex printing, a switch-back type reversal conveyance roller 46 that reverses a direction of conveyance of the sheet P, and a reversal conveyance path 47 are further provided above the fixing device 90. The direction of conveyance of the sheet P temporarily stored in the reversal conveyance path 47 is reversed by the reversal conveyance roller 46, and then the sheet P is conveyed through a duplex conveyance path by first and second duplex conveyance rollers 48 and 49 to reach the registration roller 41 again.

A description is now given of operations of the image forming apparatus 100. Upon the start of image formation, first, the pressing plate is opened to place a document on the contact glass 25*a* of the scanner 25. Alternatively, a document may be set on a document stand of the ADF.

When a start button provided to a control panel, not shown, is pressed, the document set on the ADF is conveyed onto the contact glass 25*a*, and then the scanner 25 is driven. By contrast, in a case in which the document is placed on the contact glass 25*a*, the scanner 25 is driven immediately after the start button is pressed. Accordingly, a first scanning member including the light source 25*b* and the first mirror 25*c* and a second scanning member including the second mirror 25*d* and the third mirror 25*e* are driven. Light emitted from the light source 25*b* onto the document is reflected from the document, and the light thus reflected is further reflected by the first mirror 25*c* to be directed onto the second scanning member so that the second and third mirrors 25*d* and 25*e* reflect the light to cause the light to enter the image sensor 25*g* via the imaging lens 25*f*. As a result, the image sensor 25*g* reads image data of the document. Thereafter, when a print mode or an automatic mode is selected via the control panel, image formation is performed in a full-color mode or a monochrome mode based on the image data of the document thus read.

In the printer unit 22, first, the chargers 32 evenly charge the respective photoconductors 31. Then, the optical writing unit 33 scans the photoconductors 31 with laser beams to form electrostatic latent images on the photoconductors 31, respectively. The electrostatic latent images thus formed are developed with toner by the respective developing devices 34 so that toner images of the specified colors are formed on surfaces of the photoconductors 31, respectively.

A primary transfer voltage is supplied to each of the primary transfer rollers 35 to primarily transfer the toner images from the surfaces of the photoconductors 31 onto the intermediate transfer belt 37*a* at primary transfer positions. Accordingly, the toner images are sequentially transferred onto the same position on the intermediate transfer belt 37*a* from the surfaces of the photoconductors 31 and are superimposed one atop the other to form a single full-color toner image on the intermediate transfer belt 37*a*.

In synchronization with primary transfer of the toner images, the sheet P is fed from the first or second sheet feed cassette 23*a* or 23*b* by the first or second sheet feeder 39*a* or 39*b* and is conveyed to the registration roller 41. Alternatively, the sheet P may be manually fed from a manual sheet feeder 29 and be conveyed to the registration roller 41 by a manual sheet feed roller 50. A sensor, not shown, detects that a leading edge of the sheet P reaches the registration roller 41. The registration roller 41 conveys the sheet P to a secondary transfer position formed between the secondary transfer roller 8 and the intermediate transfer belt 37*a* at a predetermined timing based on a detection signal output from the sensor. Accordingly, the full-color toner image formed on the intermediate transfer belt 37*a* is secondarily transferred onto the sheet P by the secondary transfer roller 8. The sheet P having the full-color toner image thereon is then conveyed to the fixing device 90. In the fixing device 90, heat and pressure are applied to the sheet P to fix the toner image onto the sheet P. The sheet P having the fixed toner image thereon is further conveyed by the conveyance roller 43 and is discharged to the sheet discharger 24 by the discharge roller 44. Thus, the full-color image is formed on the sheet P.

When a duplex mode is selected via the control panel to perform duplex image formation, the switching pick 45 switches the conveyance path of the sheet P so that the sheet P having the image on a front side thereof is temporarily stored in the reversal conveyance path 47. Thereafter, the direction of conveyance of the sheet P is reversed by the reversal conveyance roller 46 using a switch-back system. Accordingly, the sheet P is conveyed through the duplex conveyance path by the first and second duplex conveyance rollers 48 and 49 to reach the registration roller 41 again in synchronization with image formation. The sheet P is conveyed to the secondary transfer position again by the registration roller 41 so that a full-color toner image is secondarily transferred onto a back side of the sheet P from the intermediate transfer belt 37*a*. The sheet P having the full-color toner image on the back side thereof is then conveyed to the fixing device 90. In the fixing device 90, heat and pressure are applied to the sheet P to fix the toner image onto the back side of the sheet P. The sheet P having the fixed toner images on both the front and back sides thereof is further conveyed by the conveyance roller 43 and is discharged to the sheet discharger 24 by the discharge roller 44. Thus, the full-color images are formed on both the front and back sides of the sheet P.

It is to be noted that, after primary transfer of the toner images from the surfaces of the photoconductors 31 onto the intermediate transfer belt 37*a*, the cleaning devices 36 remove residual toner from the photoconductors 31, respectively. Thereafter, the photoconductors 31 are neutralized and charged simultaneously by the chargers 32, each of which is supplied with a direct voltage superimposed with an alternate voltage, to be ready for the next sequence of image formation. In addition, the intermediate transfer belt 37*a* is cleaned by the belt cleaning device 38 after secondary transfer of the full-color toner image from the intermediate transfer belt 37*a* onto the sheet P to be ready for the next sequence of image formation.

It is to be noted that the configuration of the image forming apparatus 100 is not limited to the above-described example. Alternatively, in place of the tandem-type image forming unit illustrated in FIG. 1, the image forming apparatus 100 may include a single-drum-type full-color image forming unit in which a single photoconductor, multiple developing devices, and an intermediate transfer member are provided. Further alternatively, the image forming apparatus 100 may include a monochrome image forming unit that forms only monochrome images.

It is also to be noted that the image forming apparatus 100 may be used as a printer when the scanner 25 is not provided thereto.

Figure 2:
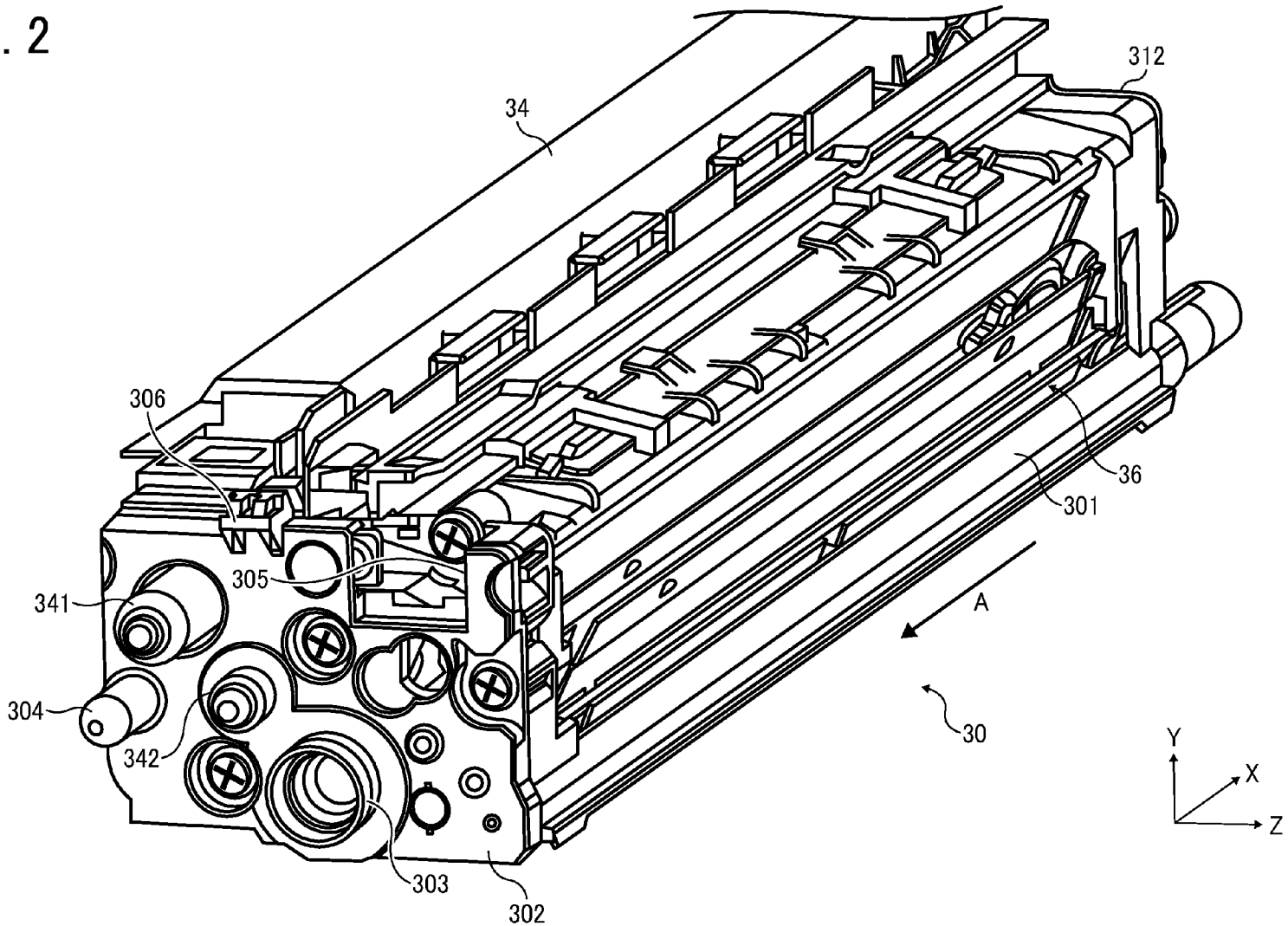
FIG. 2 is a perspective view illustrating an example of a configuration of a process cartridge detachably installable in the image forming apparatus viewed from the back.

FIG. 2 is a perspective view illustrating an example of a configuration of the process cartridge 30 viewed from the back, that is, a direction of insertion of the process cartridge 30 into the body of the image forming apparatus 100. As described previously, each of the four process cartridges 30 has the same basic configuration, differing only in the color of toner used. Therefore, only one of the process cartridges 30 is hereinafter shown as a representative example without the suffixes Y, C, M, and K, each representing the color of toner. The direction of insertion of the process cartridge 30 into the image forming apparatus 100 as indicated by an arrow A in FIG. 2 is hereinafter also referred to as an X-axis direction, and a vertical direction in FIG. 2 is hereinafter also referred to as an Y-axis direction.

The developing device 34 is first positioned temporarily relative to a frame 301 of the process cartridge 30, and then is positioned relative to a back plate 302 and a front plate 312 attached to a drive side and an opposite side of the frame 301, respectively. A photoconductor insertion hole into which a photoconductor bearing 303 rotatably supporting a flange of the photoconductor 31 is fitted and a developing insertion hole into which a developing bearing 342 supporting a shaft of a developing roller provided in the developing device 34 is fitted are provided to both the front and back plates 312 and 302. Thus, the photoconductor bearings 303 are fitted into the photoconductor insertion holes respectively provided to the front and back plates 312 and 302 and the developing bearings 342 are fitted into the developing insertion holes respectively provided to the front and back plates 312 and 302, so that both the photoconductor 31 and the developing roller are accurately positioned relative to each other by the front and back plates 312 and 302 to construct the process cartridge 30 in which the photoconductor 31 and the developing device 34 are formed together as a single integrated unit. Further, a distance between the central axis of the photoconductor 31 and that of the developing roller is accurately restricted by the front and back plates 312 and 302. Therefore, in a case in which the photoconductor 31 and the developing roller are disposed opposite each other across a minute gap, that gap is maintained accurately, thereby providing formation of higher-quality toner images on the photoconductor 31. In addition, in a case in which the photoconductor 31 and the developing roller are disposed to contact each other, a contact pressure between the photoconductor 31 and the developing roller is accurately restricted to achieve formation of higher-quality toner images on the photoconductor 31.

The cleaning device 36 is fixed to the frame 301 of the process cartridge 30. Although not shown in FIG. 2, the charger 32 is attached to a mount 305 provided to the back plate 302.

A part of the photoconductor bearing 303 fitted into the photoconductor insertion hole provided to the back plate 302 protrudes from the back plate 302, and the protruding part of the photoconductor bearing 303 functions as a back main reference portion of the process cartridge 30. The process cartridge 30 further includes a drive transmission mechanism that transmits a drive force to the developing roller and an agitation screw both included in the developing device 34. An input gear 341 of the drive transmission mechanism is inserted into the back plate 302. A sub-reference portion 304 that protrudes beyond the surface of the back plate 302 functions as a back sub-reference portion of the process cartridge 30.

A back receiver 306 that receives a pressing force from a back pressing mechanism 110 described in detail later is provided at an upper edge of the back plate 302. The back receiver 306 is provided between the sub-reference portion 304 and the photoconductor bearing 303 in a Z-axis direction, that is, a horizontal direction in FIG. 2.

Figure 3:
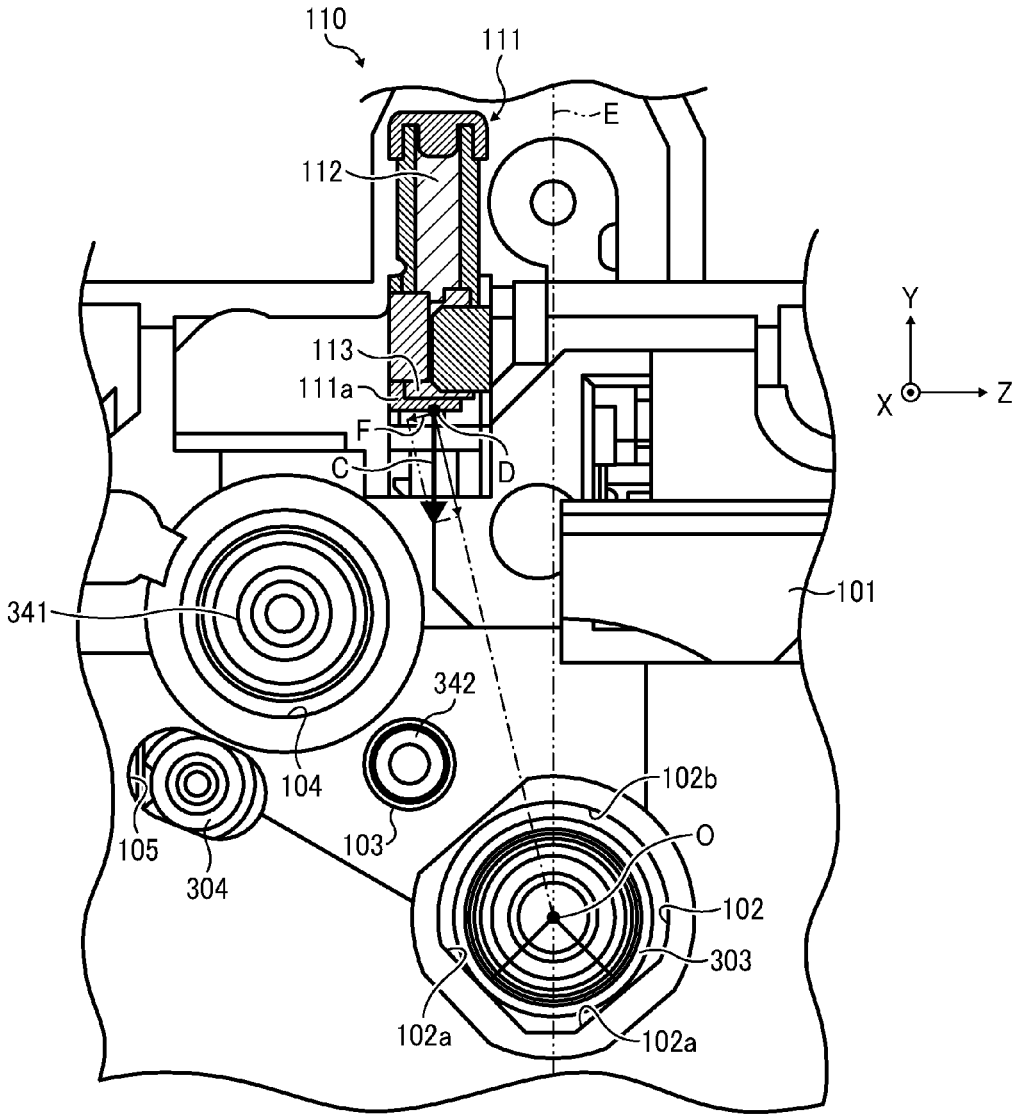
FIG. 3 is an end-on view illustrating an example of a configuration of the process cartridge set to a back plate of the body of the image forming apparatus viewed from the back.

FIG. 3 is an end-on view illustrating an example of a configuration of the process cartridge 30 set to a back plate 101 of the body of the image forming apparatus 100 viewed from the back.

The back plate 101 of the body of the image forming apparatus 100 has a photoconductor through-hole 102 into which the protruding part of the photoconductor bearing 303 is inserted, a developing through-hole 103 into which a part of the developing bearing 342 protruding from the back plate 302 is inserted, and a gear through-hole 104 into which a part of the input gear 341 protruding from the back plate 302 is inserted. In addition, a slot 105 serving as a back sub-reference portion receiver into which a part of the sub-reference portion 304 protruding from the back plate 302 is inserted is formed in the back plate 101 of the image forming apparatus 100. When viewed from the direction of insertion of the process cartridge 30 into the body of the image forming apparatus 100, the photoconductor through-hole 102 is constructed of two lower linear portions 102*a* and an upper arc-shaped portion 102*b* continuous with the two linear portions 102*a*. Upon insertion of the photoconductor bearing 303 serving as the back main reference portion of the process cartridge 30 into the photoconductor through-hole 102, the outer circumference of the photoconductor bearing 303 contacts the two linear portions 102*a*. Thus, each of the two linear portions 102*a* of the photoconductor through-hole 102 functions as a back main reference portion receiver that receives the back main reference portion of the process cartridge 30, that is, the outer circumference of the photoconductor bearing 303. The back pressing mechanism 110 that presses the process cartridge 30 is provided to the back plate 101 of the body of the image forming apparatus 100.

Figure 4:
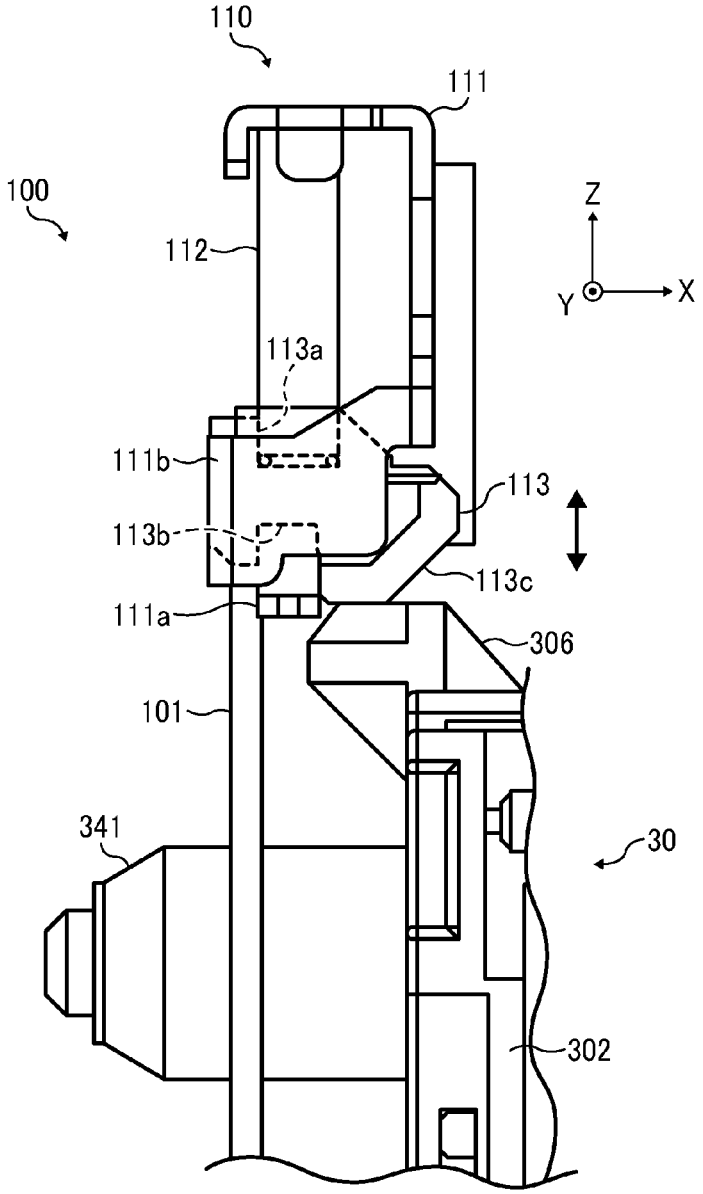
FIG. 4 is a partial side view illustrating an example of a configuration of the process cartridge installed in the image forming apparatus.
Figure 5:
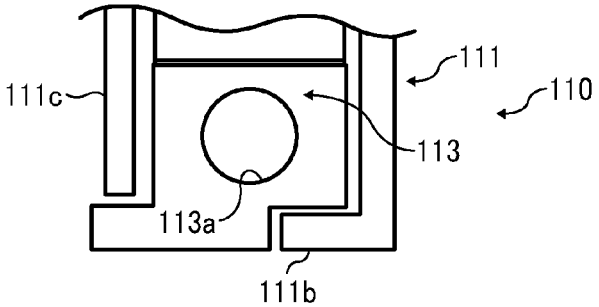
FIG. 5 is a schematic view illustrating an example of a configuration of a back pressing mechanism provided to the image forming apparatus.

FIG. 4 is a partial side view illustrating an example of a configuration of the process cartridge 30 installed in the image forming apparatus 100. FIG. 5 is a schematic view illustrating an example of a configuration of the back pressing mechanism 110.

The back pressing mechanism 110 includes a contact member 113 that contacts the back receiver 306 of the process cartridge 30, an elastic member 112 such as a spring that presses the contact member 113 against the process cartridge 30, and a holding case 111 that holds both the contact member 113 and the elastic member 112. An end of the elastic member 112 is fixed to a concave receiver 113*a* provided on an upper surface of the contact member 113, and the other end thereof is fixed to an upper surface of the holding case 111. A cutout 113*b* is provided on a lower surface of the contact member 113 so that the bottom of the cutout 113*b* contacts a receiver 111*a* provided to the holding case 111 when the process cartridge 30 is not installed in the image forming apparatus 100. A tapered surface 113*c* tilting upward to the front, that is, the right side in FIG. 4, is provided to a front surface of the contact member 113.

The holding case 111 has an opposing surface 111*b* that faces a back surface of the contact member 113. A part of the back surface of the contact member 113 protrudes backward to face an end of a surface 111*c* of the holding case 111 extending in the direction of insertion of the process cartridge 30. The above-described configuration enables the contact member 113 to be slidably held by the holding case 111 in the Y-axis direction, that is, a pressing direction in which the back pressing mechanism 110 presses the process cartridge 30.

As described above, when the process cartridge 30 is not installed in the image forming apparatus 100, the bottom of the cutout 113*b* contacts the receiver 111*a* of the holding case 111. When the process cartridge 30 is inserted into the body of the image forming apparatus 100, the back receiver 306 of the process cartridge 30 contacts the tapered surface 113*c* of the contact member 113. The process cartridge 30 is further inserted into the body of the image forming apparatus 100 after the back receiver 306 contacts the tapered surface 113*c* of the contact member 113. Accordingly, the contact member 113 is lifted against a pressing force of the elastic member 112 to compress and deform the elastic member 112. As a result, the contact member 113 is placed on the back receiver 306 upon installation of the process cartridge 30 in the image forming apparatus 100 as illustrated in FIG. 4. At this time, the elastic member 112 is compressed to supply a predetermined amount of the pressing force to the process cartridge 30 via the contact member 113.

When the process cartridge 30 is pressed downward by the back pressing mechanism 110, the outer circumference of the photoconductor bearing 303 is pressed against the two linear portions 102*a* of the photoconductor through-hole 102. As a result, the outer circumference of the photoconductor bearing 303 contacts the two linear portions 102*a* without looseness as illustrated in FIG. 3. Thus, the process cartridge 30 is reliably positioned relative to the body of the image forming apparatus 100 in the Y-axis and Z-axis directions. In addition, as illustrated in FIG. 3, the back pressing mechanism 110 presses the process cartridge 30 in the pressing direction indicated by an arrow C which is angled with respect to a line OD connecting the center O of the photoconductor bearing 303 with a contact position D where the back pressing mechanism 110 contacts the process cartridge 30 to press the process cartridge 30. Accordingly, in addition to the pressing force that presses the photoconductor bearing 303 against the two linear portions 102*a*, a pressing force indicated by an arrow F in FIG. 3 that rotates the process cartridge 30 around the photoconductor bearing 303 acts on the process cartridge 30. As a result, the sub-reference portion 304 of the process cartridge 30 is pressed against the slot 105 in a lateral direction of the slot 105 to contact the side of the slot 105 without looseness around the X axis, and the process cartridge 30 is reliably positioned relative to the body of the image forming apparatus 100 around the X axis. Thus, the photoconductor bearing 303 and the sub-reference portion 304 reliably contact the linear portions 102*a* of the photoconductor through-hole 102 and the slot 105, respectively, to accurately position the process cartridge 30 relative to the body of the image forming apparatus 100 using a single pressing mechanism, that is, the back pressing mechanism 110, thereby reducing number of components and production costs. The process cartridge 30 accurately positioned relative to the body of the image forming apparatus 100 does not shake in the Y-axis and Z-axis directions and around the X axis during operation, thereby preventing formation of irregular images including banding and so forth.

Accurate positioning of the process cartridge 30 relative to the body of the image forming apparatus 100 can reliably keep a writing position where the electrostatic latent image is written on the photoconductor 31 and the primary transfer position where the toner image is primarily transferred onto the intermediate transfer belt 37*a* from the photoconductor 31. In addition, the position of the input gear 341 of the developing device 34 is accurately secured. Therefore, in a case in which the drive force is transmitted by gears, pitches between the gears can be accurately kept to achieve stable rotation of the developing roller, thereby providing higher-quality images. Even in a case in which the drive force is transmitted by a coupling, displacement between the input gear 341 and an axis of the coupling can be minimized, thereby preventing rotary fluctuation in the developing roller.

Further, the back pressing mechanism 110 presses the process cartridge 30 in the pressing direction parallel to a bisector E of an angle formed by lines connecting the center O of the photoconductor bearing 303 with each of contacts points where the outer circumference of the photoconductor bearing 303 contacts the two linear portions 102*a* of the photoconductor through-hole 102. Accordingly, the photoconductor bearing 303 is evenly and reliably pressed against the two linear portions 102*a*, thereby further preventing the process cartridge 30 from shaking in the Y-axis and Z-axis directions.

Figure 6:
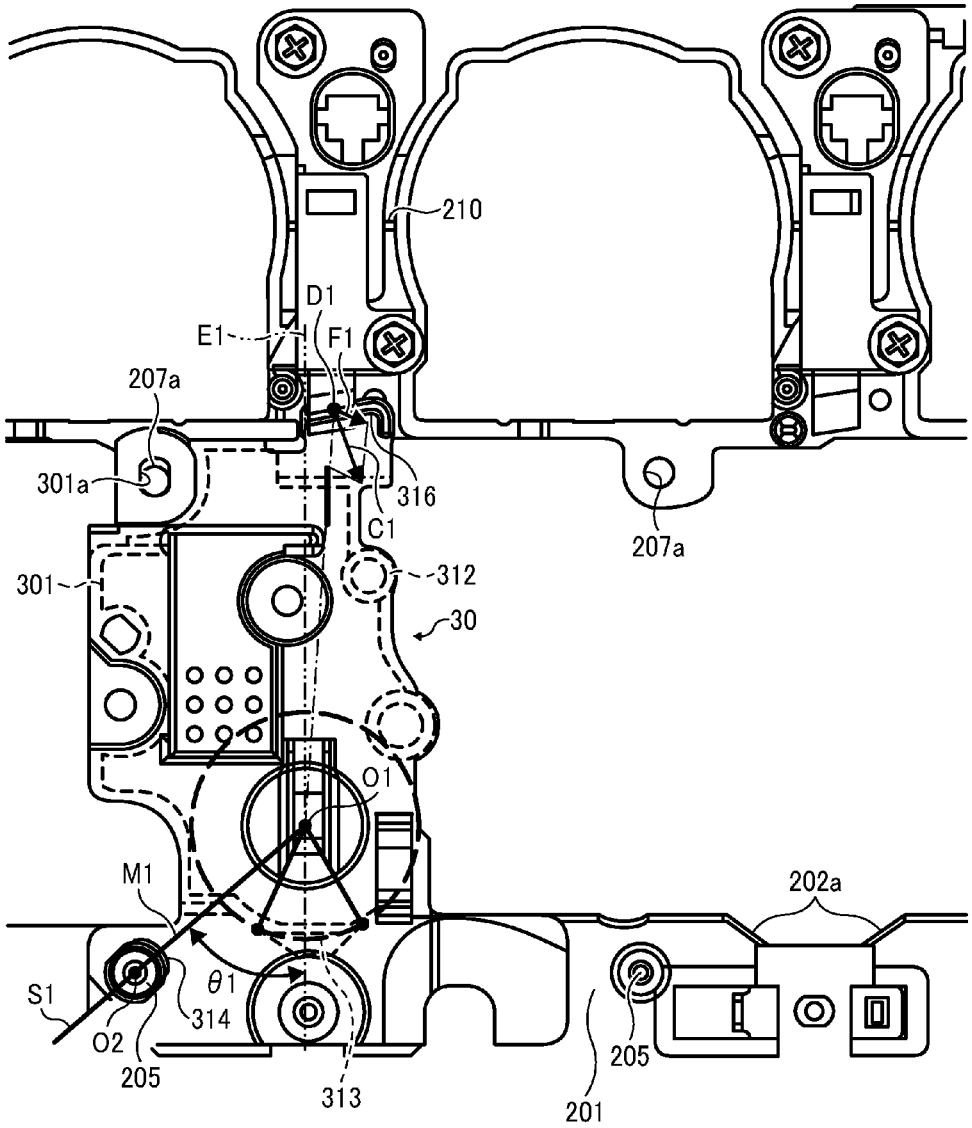
FIG. 6 is a schematic view illustrating an example of a configuration of the process cartridge set to the back plate of the body of the image forming apparatus viewed from the front.

When the process cartridge 30 is installed in the body of the image forming apparatus 100 as described above, a screw serving as a fastening member is inserted into a screw hole 301*a* provided to the front plate 312 of the process cartridge 30 and a screw hole 207*a* provided to a front plate 201 of the image forming apparatus 100, both shown in FIG. 6, to fasten the screw. Thus, the process cartridge 30 is fastened to the body of the image forming apparatus 100 with the fastening member such as a screw. As a result, the process cartridge 30 is installed in the image forming apparatus 100 without looseness in the X-axis direction.

Although the photoconductor bearing 303 serves as the back main reference portion in the above-described example, alternatively, the back main reference portion may be provided to the back plate 302 of the process cartridge 30. In addition, although each of the two linear portions 102*a* of the photoconductor through-hole 102 serves as the back main reference portion receiver that receives the back main reference portion of the process cartridge 30, the shape of the back main reference portion receiver is not limited thereto. Alternatively, the back main reference portion receiver may have a shape that restricts movement in the Y-axis and Z-axis directions of the back main reference portion, that is, the photoconductor bearing 303, pressed by the back pressing member 110. For example, the back main reference portion receiver may have a circular shape having substantially the same diameter as the outer diameter of the photoconductor bearing 303. Accordingly, the outer circumference of the photoconductor bearing 303 contacts the circular portion of the back main reference portion receiver to restrict movement of the photoconductor bearing 303 in both the Y-axis and Z-axis directions. As a result, the process cartridge 30 is positioned relative to the body of the image forming apparatus 100 in the Y-axis and Z-axis directions. Further, although the slot 105 serves as the back sub-reference portion receiver that receives the sub-reference portion 304 of the process cartridge 30, the shape of the back sub-reference portion receiver is not limited thereto as long as the sub-reference portion 304 pressed by the back pressing mechanism 110 contacts the back sub-reference portion receiver. For example, a flat portion extending in the X-axis direction may be provided to the back plate 101 of the image forming apparatus 100 such that the sub-reference portion 304 contacts the flat portion.

It is preferable that the front side of the process cartridge 30 have the same configuration as the back side of the process cartridge 30 described above.

FIG. 6 is a schematic view illustrating an example of a configuration of the process cartridge 30 installed in the body of the image forming apparatus 100 viewed from the front.

A circular front main reference portion 313 concentric with the rotary center of the photoconductor 31 is provided to a front side of the frame 301 of the process cartridge 30. In addition, a slot 314 serving as a front sub-reference portion is provided to the front plate 312 of the process cartridge 30, and a front sub-reference portion boss 205 serving as a front sub-reference portion receiver is provided to the front plate 201 of the image forming apparatus 100. Alternatively, a boss may be provided to serve as the front sub-reference portion, and a slot may be provided to serve as the front sub-reference portion receiver.

The front plate 201 of the image forming apparatus 100 further has two linear front main reference portion receivers 202*a* that contact and receive the front main reference portion 313. A front pressing mechanism 210 that presses the process cartridge 30 is provided to the front plate 201 of the image forming apparatus 100. In addition, a front receiver 316 that contacts the front pressing mechanism 210 to receive a pressing force from the front pressing mechanism 210 when the process cartridge 30 is installed in the image forming apparatus 100 is provided to the front plate 312 of the process cartridge 30.

As illustrated in FIG. 6, a leading edge of the front receiver 316 is tilted downward. Accordingly, the front pressing member 210 presses the process cartridge 30 in a direction indicated by an arrow C1 which is angled with respect to a line O1D1 connecting the center O1 of the front main reference portion 313 with a contact position D1 where the front pressing mechanism 210 contacts the process cartridge 30 to press the process cartridge 30. Accordingly, in addition to the pressing force that presses the front main reference portion 313 against the two front main reference portion receivers 202*a*, a pressing force that rotates the process cartridge 30 around the front main reference portion 313 acts on the process cartridge 30 as indicated by an arrow F1 in FIG. 6. As a result, the slot 105 is pressed in a lateral direction thereof to contact the front sub-reference portion boss 205. Thus, the front side of the process cartridge 30 is also reliably positioned relative to the body of the image forming apparatus 100 around the X axis.

A description is now given of a variation of the present illustrative embodiment.

Figure 7:
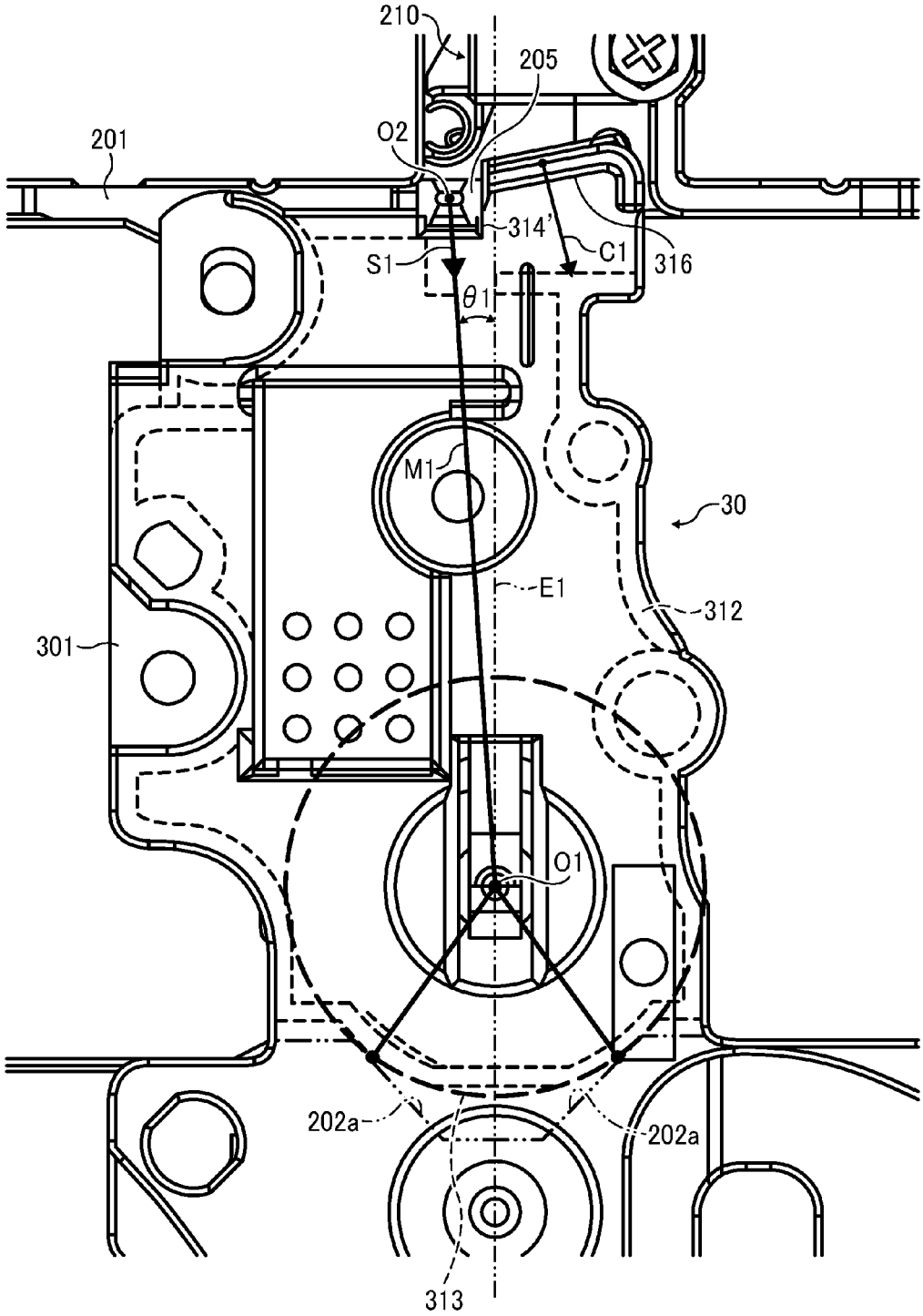
FIG. 7 is a schematic view illustrating an example of a configuration of a process cartridge installed in an image forming apparatus according to a variation, viewed from the front.

FIG. 7 is a schematic view illustrating an example of a configuration of the process cartridge 30 set in the body of the image forming apparatus 100 according to the variation, viewed from the front.

In the variation, the center O2 of the front sub-reference portion is positioned near a bisector E1 of an angle formed by lines connecting the center O1 of the front main reference portion 313 and each of contacts points where the front main reference portion 313 contacts the two front main reference portion receivers 202*a*.

The process cartridge 30 is inserted into the body of the image forming apparatus 100 from the front to the back. The back part of the process cartridge 30 is moved along guide rails, not shown, provided to the body of the image forming apparatus 100, so that the photoconductor bearing 303 serving as the back main reference portion is supported by the two linear portions 102*a* of the photoconductor through-hole 102, each of which serves as the back main reference portion receiver and is provided to the back plate 101 of the body of the image forming apparatus 100. In addition, the sub-reference portion 304 is inserted into the slot 105 serving as the back sub-reference portion receiver. As a result, the process cartridge 30 is accurately installed in the image forming apparatus 100.

By contrast, the front part of the process cartridge 30 is manually guided when inserted into the image forming apparatus 100. Therefore, for example, the front sub-reference portion boss 205 is inserted into the slot 314 provided to the front plate 312 of the process cartridge 30 to install the process cartridge 30 in the image forming apparatus 100 while the front part of the process cartridge 30 is lifted from the guide rails. Accordingly, when the process cartridge 30 is inserted into the body of the image forming apparatus 100 while the front part of the process cartridge 30 is lifted, a left portion of the front main reference portion 313 provided closer to the slot 314 is lifted from the left front main reference portion receiver 202*a* provided closer to the slot 314 as indicated by solid-line circle in FIG. 8 immediately after installation. Thereafter, when the process cartridge 30 is released, the slot 314 is moved relative to the front sub-reference portion boss 205 in a direction indicated by an arrow N in FIG. 8 by weight of the process cartridge 30 and the pressing force from the front pressing mechanism 210 so that the left portion of the front main reference portion 313 contacts the left front main reference portion receiver 202*a* as indicated by a broken-line circle.

Figure 8:
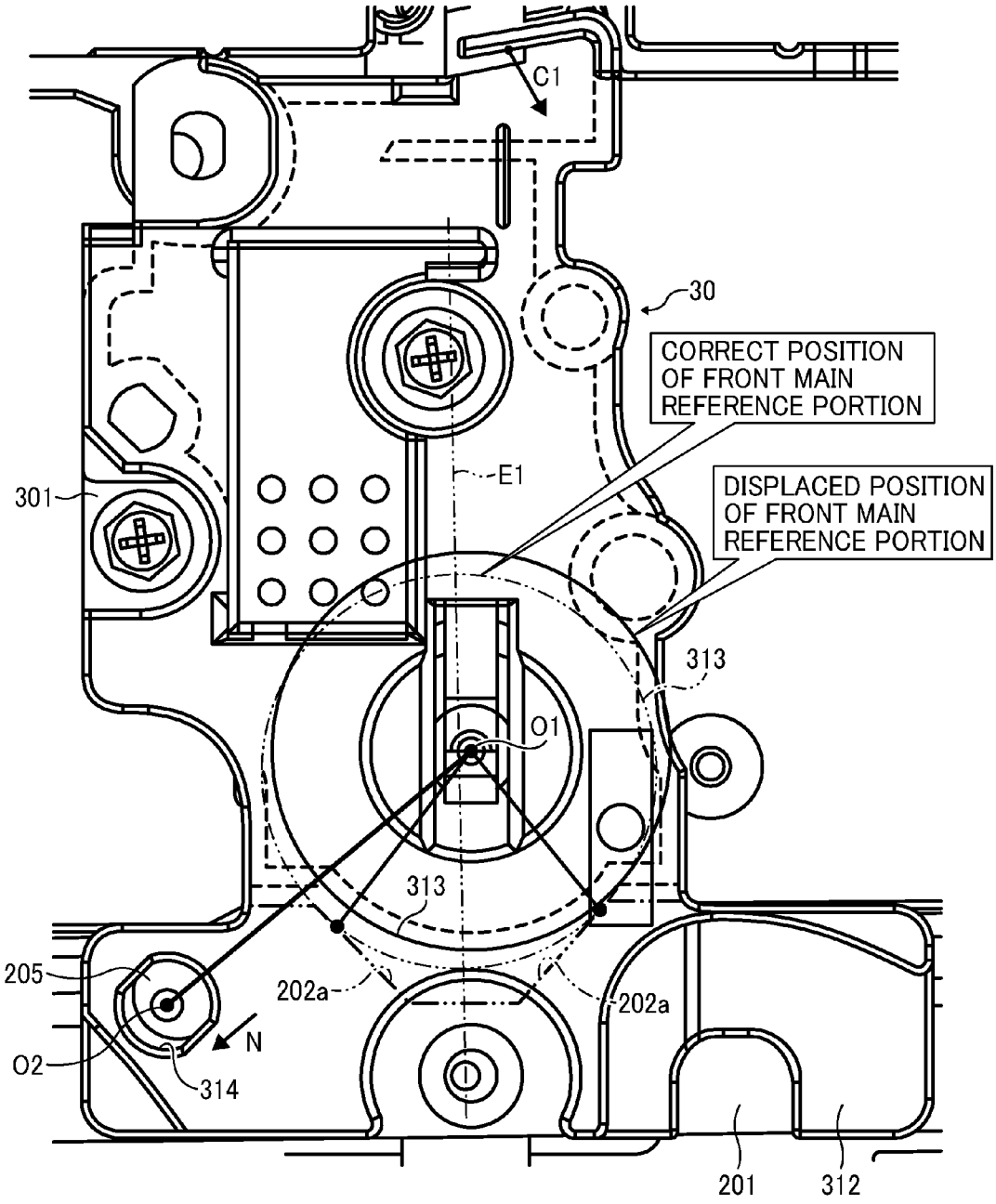
FIG. 8 is a schematic view illustrating an example of a configuration of the process cartridge installed in the image forming apparatus with looseness.

In other words, when released after insertion, the process cartridge 30 is moved in a direction parallel to a line connecting the center O1 of the front main reference portion 313 with the center O2 of the front sub-reference portion, that is, the slot 314 in FIG. 8, by the weight of the process cartridge 30 and the pressing force from the front pressing mechanism 210 so that the left portion of the front main reference portion 313 contacts the left front main reference portion receiver 202*a* provided closer to the slot 314.

At this time, when damage or foreign substances attaching to the front sub-reference portion boss 205 or an inner circumference of the slot 314 due to repeated insertion and detachment of the process cartridge 30 in and from the image forming apparatus 100 increases a static frictional force between the slot 314 and the front sub-reference portion boss 205, the slot 314 may not be moved relative to the front sub-reference portion boss 205 by the weight of the process cartridge 30 or the pressing force from the front pressing mechanism 210. Consequently, the left portion of the front main reference portion 313 may not contact and be lifted from the left front main reference portion receiver 202*a* provided closer to the slot 314 even after installation of the process cartridge 30 in the image forming apparatus 100. As a result, color shift is considerably increased in output images and image quality is degraded.

A force S1 that moves the process cartridge 30 in the direction parallel to the line connecting the center O1 and the center O2 to move the slot 314 relative to the front sub-reference portion boss 205 by weight G1 of the process cartridge 30 can be represented as $S1=G1 \cos \theta 1$. Where $\theta 1$ is an acute angle formed between the bisector E1 and a line M1 connecting the center O2 with the center O1 as shown in FIG. 6.

In the variation illustrated in FIG. 7, the center O2 of the front sub-reference portion is positioned closer to the bisector E1. Accordingly, the angle $\theta 1$ is reduced and the force S1 that moves the process cartridge 30 in the direction parallel to the line M1 connecting the center O1 and the center O2 by the weight G1 of the process cartridge 30 can be increased. In addition, the force that moves the process cartridge 30 pressed by the front pressing mechanism 210 in the direction substantially parallel to the bisector E1 to the direction parallel to the line M1 is also increased. As a result, even in a case of increasing the static frictional force between the front sub-reference portion and the front sub-reference portion receiver, the process cartridge 30 is moved in the direction of the line M1 by the weight G1 of the process cartridge 30 and the pressing force from the front pressing mechanism 210. Thus, the front main reference portion 313 reliably contacts the front main reference portion receivers 202*a* by the weight G1 of the process cartridge 30 and the pressing force from the front pressing mechanism 210 even when the process cartridge 30 is installed in the image forming apparatus 100 while the front part of the process cartridge 30 is lifted, thereby accurately positioning the process cartridge 30 relative to the body of the image forming apparatus 100.

Specifically, the center O2 of the front sub-reference portion is positioned sufficiently closer to the bisector E1 when the angle θ1 is not greater than 30°. As a result, the process cartridge 30 can be moved in the direction of the line M1 by the weight G1 of the process cartridge 30 and the pressing force from the front pressing mechanism 210 even in the case of increasing the static frictional force between the front sub-reference portion and the front sub-reference portion receiver.

In the variation, a cutout 314' serving as the front sub-reference portion is formed parallel to the line M near the front receiver 316 in an upper portion of the front plate 312, and the front sub-reference portion boss 205 having a shape of a quadratic prism that serves as the front sub-reference portion receiver to be fitted into the cutout 314' is provided to the front plate 201 of the image forming apparatus 100. Needless to say, the configuration of the front sub-reference portion and the front sub-reference portion receiver according to the variation is not limited thereto. Alternatively, the front sub-reference portion may be shaped like a slot and the front sub-reference portion receiver may be constructed of a cylinder boss in a manner similar to the example illustrated in FIG. 6.

In the variation illustrated in FIG. 7, the line M1 connecting the center O2 of the cutout 314' with the center O1 of the front main reference portion 313 is substantially parallel to the direction of the pressing force from the front pressing mechanism 210 indicated by an arrow C1. Accordingly, most of the pressing force from the front pressing mechanism 210 can be used for moving the process cartridge 30 in the direction of the line M1. As a result, the front main reference portion 313 reliably contacts the front main reference portion receivers 202*a*.

It is to be noted that the back part of the process cartridge 30 may have the same configuration as the front part thereof as illustrated in FIG. 7. In the above-described example, the weight G1 of the process cartridge 30 acts as the force that causes the front main reference portion 313 to reliably contact the front main reference portion receivers 202*a*. Alternatively, for example, the front main reference portion receivers 202*a* may be provided above the front main reference portion 313 and the front pressing mechanism 210 may press the process cartridge 30 against the weight G1 of the process cartridge 30 to cause the front main reference portion 313 to contact the front main reference portion receivers 202*a*. In such a case, the center O2 of the front sub-reference portion is positioned closer to the bisector E1 so that the process cartridge 30 is smoothly moved by the pressing force from the front pressing mechanism 210 to cause the front main reference portion 313 to reliably contact the front main reference portion receivers 202*a* upon installation of the process cartridge 30 in the image forming apparatus 100.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

a process cartridge detachably installable in a main body of the image forming apparatus, the process cartridge including an image carrier and at least one processing unit provided adjacent to the image carrier;

a main reference portion receiver to receive a main reference portion provided to the process cartridge;

a sub-reference portion receiver to receive a sub-reference portion provided to the process cartridge; and a pressing mechanism to press the process cartridge to cause the main reference portion to contact the main reference portion receiver upon installation of the process cartridge in the main body of the image forming apparatus, wherein the pressing mechanism presses the process cartridge in a direction angled with respect to a line connecting a center of the main reference portion with a contact position where the pressing mechanism contacts the process cartridge, wherein the pressing mechanism is disposed on the image forming apparatus and includes:

a contact member to contact the process cartridge, having a tapered surface;

an elastic member to press the contact member against the process cartridge; and a holding case to hold both the contact member and the elastic member, wherein a first end of the elastic member is fixed to a concave receiver provided on an upper surface of the contact member and a second end opposite the first end is fixed to an upper surface of the holding case, and a cutout is provided on a lower surface of the contact member so that a bottom of the cutout contacts a receiver provided to the holding case when the process cartridge is not installed in the image forming apparatus.

2. An image forming apparatus, comprising:

a process cartridge detachably installable in a main body of the image forming apparatus, the process cartridge including an image carrier and at least one processing unit provided adjacent to the image carrier;

a main reference portion receiver to receive a main reference portion provided to the process cartridge;

a sub-reference portion receiver to receive a sub-reference portion provided to the process cartridge; and a pressing mechanism to press the process cartridge to cause the main reference portion to contact the main reference portion receiver upon installation of the process cartridge in the main body of the image forming apparatus, wherein the pressing mechanism presses the process cartridge in a direction angled with respect to a line connecting a center of the main reference portion with a contact position where the pressing mechanism contacts the process cartridge, wherein:

the main reference portion receiver receives the main reference portion at two points;

the main reference portion has an arc-shaped portion with tangential lines from the two points in which the main reference portion receiver and the main reference portion contact each other;

the sub-reference portion is movable relative to the sub-reference portion receiver in a direction parallel to a line connecting a center of the sub-reference portion and the center of the main reference portion; and the center of the sub-reference portion is positioned near a bisector of an angle formed by a line connecting the center of the main reference portion with one of the contact points and a line connecting the center of the main reference portion with the other one of the contact points.

3. The image forming apparatus according to claim 2, wherein an angle θ1 formed between the bisector and the line connecting the center of the sub-reference portion with the center of the main reference portion is not greater than 30°.

4. An image forming apparatus, comprising:

a process cartridge detachably installable in a main body of the image forming apparatus, the process cartridge including an image carrier and at least one processing unit provided adjacent to the image carrier;

a main reference portion receiver to receive a main reference portion provided to the process cartridge;

a sub-reference portion receiver to receive a sub-reference portion provided to the process cartridge; and a pressing mechanism to press the process cartridge to cause the main reference portion to contact the main reference portion receiver upon installation of the process cartridge in the main body of the image forming apparatus, wherein the pressing mechanism presses the process cartridge in a direction angled with respect to a line connecting a center of the main reference portion with a contact position where the pressing mechanism contacts the process cartridge, wherein:

the main reference portion receiver receives the main reference portion at two points;

the main reference portion has an arc-shaped portion with tangential lines from the two points in which the main reference portion receiver and the main reference portion contact each other; and the pressing mechanism presses the process cartridge in a direction parallel to a bisector of an angle formed by a line connecting the center of the main reference portion with one of the contact points and a line connecting the center of the main reference portion with the other one of the contact points.

5. The image forming apparatus according to claim 1, further comprising multiple process cartridges detachably installable in the main body of the image forming apparatus, each of the multiple process cartridges comprising the image carrier and the at least one processing unit provided adjacent to the image carrier.

6. The image forming apparatus according to claim 1, wherein the process cartridge is fixed to the main body of the image forming apparatus with a fastening member after installation of the process cartridge in the main body of the image forming apparatus.

7. The image forming apparatus according to claim 6, wherein the fastening member is a screw.

8. The image forming apparatus according to claim 2, further comprising multiple process cartridges detachably installable in the main body of the image forming apparatus, each of the multiple process cartridges comprising the image carrier and the at least one processing unit provided adjacent to the image carrier.

9. The image forming apparatus according to claim 2, wherein the process cartridge is fixed to the main body of the image forming apparatus with a fastening member after installation of the process cartridge in the main body of the image forming apparatus.

10. The image forming apparatus according to claim 9, wherein the fastening member is a screw.

11. The image forming apparatus according to claim 4, further comprising multiple process cartridges detachably installable in the main body of the image forming apparatus, each of the multiple process cartridges comprising the image carrier and the at least one processing unit provided adjacent to the image carrier.

12. The image forming apparatus according to claim 4, wherein the process cartridge is fixed to the main body of the image forming apparatus with a fastening member after installation of the process cartridge in the main body of the image forming apparatus.

13. The image forming apparatus according to claim 12, wherein the fastening member is a screw.

* * * * *